United States Patent [19]

Walter

[11] Patent Number: 4,523,540

[45] Date of Patent: Jun. 18, 1985

[54] ADHESIVE APPLICATOR

[75] Inventor: John Walter, Evergreen Park, Ill.

[73] Assignee: The Continental Group, Inc., Stamford, Conn.

[21] Appl. No.: 367,507

[22] Filed: Apr. 12, 1982

[51] Int. Cl.[3] ..... B05C 7/02; B05C 5/02

[52] U.S. Cl. ..... 118/63; 118/408; 118/DIG. 3

[58] Field of Search ..... 118/408, 317, DIG. 3, 118/50, 63

[56] References Cited

U.S. PATENT DOCUMENTS 2,884,922 5/1959 Paulsen ..... 118/410 X 3,044,907 7/1962 Bernhardt ..... 118/63 X 3,455,275 7/1969 Podesta et al. ..... 118/317

3,889,628 6/1975 Usab ..... 118/408 X

*Primary Examiner*—John P. McIntosh

*Attorney, Agent, or Firm*—Charles E. Brown

[57] ABSTRACT

Adhesive applicators having a flexible valve disk which defines a metering chamber with a valve body, the valve body with the valve is insertable into a can component in close confinement thereby and the valve is operated by flexing the disk to compress the adhesive and spurt it against the confining surface of the can body to form a bead and band of adhesive into which the other can component is subsequently telescoped.

5 Claims, 5 Drawing Figures

FIG. 1
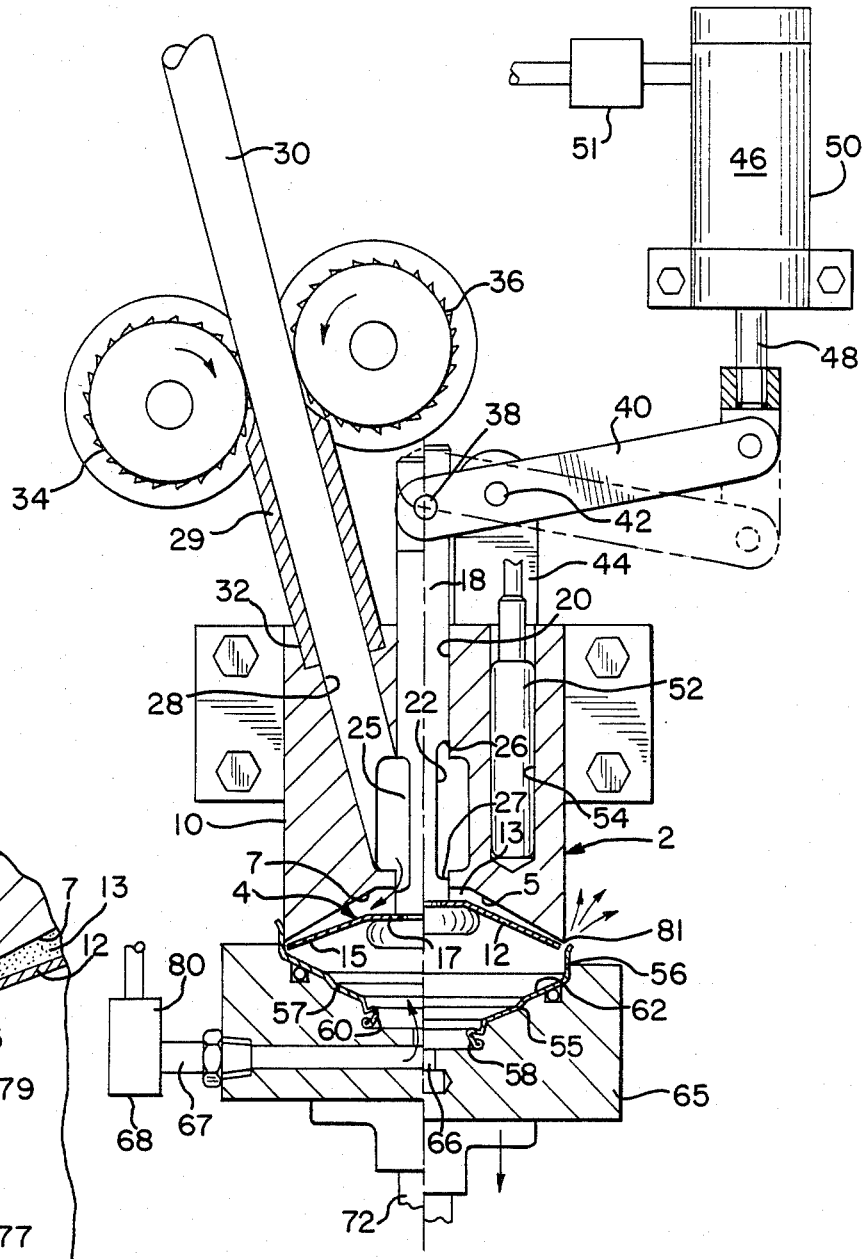
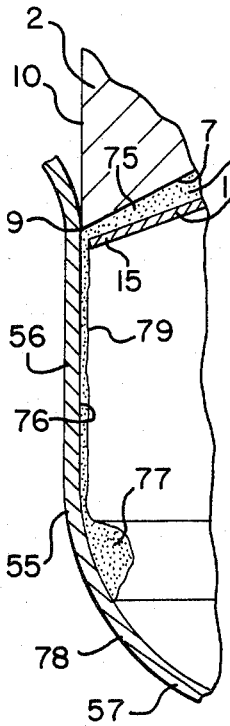
FIG. 2

ADHESIVE APPLICATOR

BACKGROUND OF THE INVENTION

This invention relates to devices for applying adhesive to the interior of one can component which is adapted to telescope with a second component, the latter having an open end portion with a raw edge which must be protected from the contents of the can to prevent off-flavor tastes or possible galvanic action. The second component may comprise a body with an integral bottom. The body is inserted into the open end of the one component and bonded thereto by the adhesive.

SUMMARY OF THE INVENTION

A principal object of the invention is to provide a novel high-speed applicator which will accurately deposit a preselected pattern of adhesive.

The invention comprehends the provision of an applicator for adhesive which comprises a body having a cylindrical end portion dimensioned to fit closely into the cylindrical interior of the can component to which the adhesive is to be applied, the body end portion being associated with a flexible valve plate which has a peripheral edge or lip which is of the same diameter as the end portion, the plate and plunger body defining an adhesive receiving metering chamber. The disk is flexed at its center to exert a pressure on the adhesive trapped in the metering chamber causing the lip to deflect away from the plunger and the adhesive to squirt out against the interior of the can component first to form a bead and then a thin band of material.

The invention oontemplates two embodiments of the invention, in one of which a plastic rod is fed which is melted and the other of which uses a molten reservoir of adhesive plastic.

The invention comprehends the provision of a novel valve structure for applying the adhesive in a forceful spray and wherein a blast of air is used to separate the adhesive from the can part so as to obtain a good separation of the adhesive between the piece part and the applicator.

These and other objects and advantages inherent in and encompassed by the invention will become more apparent from the specification and the drawings herein.

FIG. 1 is a vertical sectional view of one embodiment of the invention, the left half showing the valve closed and the right half showing the termination of the adhesive application and the valve closed.

FIG. 2 is a fragmentary enlarged sectional view showing the parts as in the right half of FIG. 1.

DESCRIPTION OF THE EMBODIMENT OF FIGS. 1 AND 2

Figure 3:
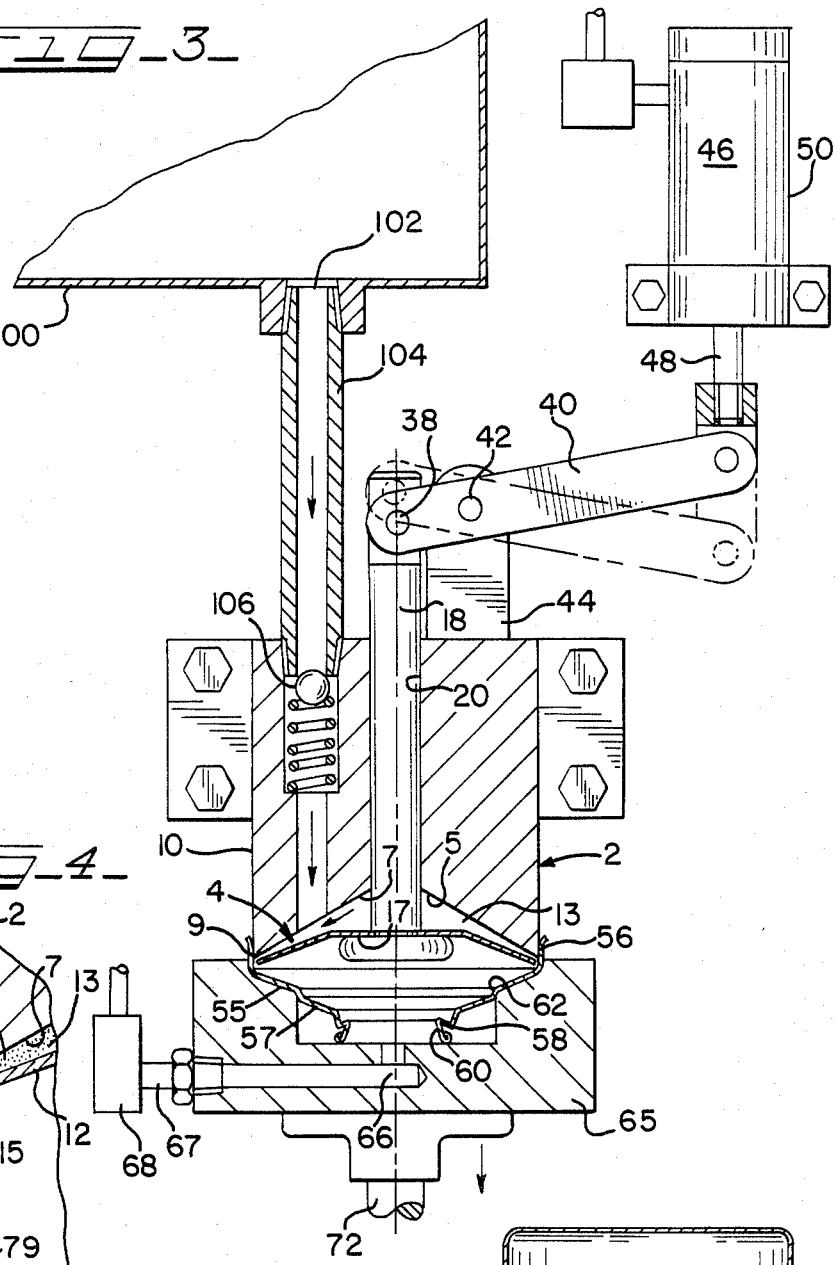
FIG. 3 is a vertical sectional view of another embodiment with the apparatus in position preparatory to initiate adhesive application.

In this embodiment there is shown a carrier or plunger 2 which is in the form of a block of metal having a valve structure generally indicated 4 at its lower end. The valve structure comprises a frusto conical cavity 5 at the bottom end of the plunger, the surface of which merges into a sharp apical annular edge 9 with the cylindrical outer surface 10 of the plunger. A Belleville spring-shaped flexible valve plate or disk 12 is cupped within the cavity and is concaved upwardly of frusto conical form but of smaller angle than the opposing surface 7 and forms a metering chamber 13 therewith. The disk 12 has an annular peripheral edge or lip 15 which coincides with the apical edge of the plunger in the closed position of the valve as seen in the left half of FIG. 1.

The flat center portion 17 of the valve plate is connected to the lower end of a valve stem 18 in any convenient manner. The stem 18 extends through a bore 20 in the plunger 2. The stem has a reduced diameter portion 22 adjacent to its lower end defining a reservoir chamber 25 between the upper and lower lands 26,27 defining the end limits of the chamber 25.

Chamber 25 upon downward displacement of the stem communicates with the metering chamber 13 and at the same time flexes the valve plate downwardly thus creating a vacuum in chamber 13 and drawing the plasticized (melted) adhesive into chamber 13 which is fed by a stick of a hotmelt plastic rod 30 which is fed into chamber 13 through a bore 28 in the plunger 2.

The bore 28 is extended into a support or guide sleeve 29 suitably press fitted into a counterbore 32 at the upper end of bore 28. The rod 32 is grasped between a pair of toothed feed wheels or rollers 34,36 which are suitably driven at a rate commensurate with the requirements to fill the chamber 13 which also encompasses an enlarged portion of the bore 20 through which the stem 18 operates.

The upper end of stem 18 is pivotally connected by a pin 38 to one end of a lever or linkage 40 which is fulcrumed intermediate its ends at 42 to a bracket 44 extending from the upper end of the plunger body which is affixed and stationary. The opposite end of the linkage 40 is pivotally connected to an actuator at 46, shown as a piston rod or plunger 48 which operates within a solenoid or air cylinder 50.

The plastic rod 30 is melted upon entering the plunger body which has a plurality of cartridge type heaters 52 pocketed in bores 54 provided in the body and heating it.

It will be apparent that the can component or the end piece 55 of the present embodiment is in the form of a dome member having an annular short peripheral skirt 56 with an outturned lip and a dome 57 and a neck 58 defining a filling and pouring bore 60.

The component 55 is complementally nested in an upwardly facing cavity 62 formed in a base 65. The base 65 has an air inlet 66 communicating with the interior of component 55, the air being supplied through conduit 67 from a conventional source of air under pressure. A suitable valve 70 is provided in line 67 to open and close the line in a manner hereinafter described.

In operation, the base 65 of the apparatus is first retracted downwardly by means of suitable push-pull rod 72 operated pneumatically, hydraulically or electrically and connected to the base 65. The end component 55 is then inserted into the cavity 62. The base and skirt are elevated and the portion 56 telescopes over the lower end of the plunger 2 until the apical edge 9 thereof is proximate the juncture of the skirt with the dome of the end member 55. The operating stem 18 is caused to move upwardly through appropriate actuation of the actuator whereupon the chamber 13 is closed off from the metering chamber and the valve plate is flexed at its center upwardly compressing the melted or plasticized adhesive in the metering chamber 13. Sufficient pressure is built up which causes the marginal edge portion or lip 15 of the disk to flex away from the edge 9 whereby the adhesive 75 spurts out against the interior surface 76 of the skirt portion 56. The movement of the stem 18 upwardly is programmed with the downward movement of the can end piece or member 55 so that initially a bead 77 of the adhesive material is formed adjacent to the juncture 78 of the skirt and the dome and then the piece 55 moves downwardly rapidly while a thin band or layer 79 of adhesive is applied to the interior surface of the skirt portion. Substantially coincidental with the quantity of adhesive in the metering chamber being exhausted and the plunger being almost completely withdrawn from the skirt, a blast of air is introduced into the interior of member 55 by opening valve 80 in the air line 67. This causes an abrupt separation of the adhesive clinging between the lip of the valve plate and the band 79 at the gap 80 and prevents the adhesive from stringing out. It will be realized that the lower land 27 closes the chamber 13 from chamber 25 when the valve stem is moved upwardly. After the adhesive application is completed the base member is lowered sufficiently to permit removal of the end piece 55 and insertion of another end piece. The valve stem then is moved downwardly moving the lower land 26 past the lower edge of bore 20 thus opening the chamber 25 to communication with chamber 13 which again develops a vacuum and draws a sufficient amount of adhesive thereinto. It will be understood that the adhesive depending upon its viscosity may also flow gravitationally from the upper chamber 25 to the lower chamber 13. The base with the end piece then moves upwardly telescoping the plunger into the skirt portion and the cycle of adhesive application as heretofore explained repeats.

DESCRIPTION OF THE EMBODIMENT OF FIGS. 3-5

Figure 4:
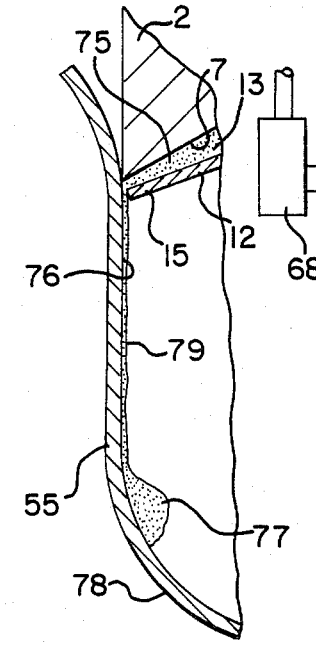
FIG. 4 shows the same section as FIG. 3 on an enlarged scale with the parts at the termination of adhesive application.
Figure 5:
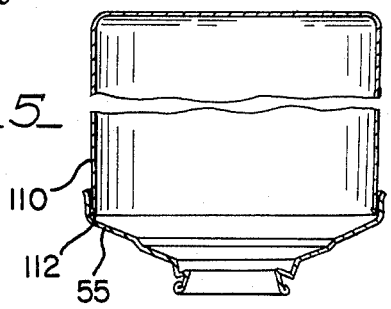
FIG. 5 shows a broken apart side elevational view partly in section of both components assembled.

The embodiment of FIGS. 3 and 4 is substantially identical to that of FIGS. 1 and 2 and like parts will be identified with corresponding reference numerals.

The essential difference resides in providing a reservoir tank 100 in which the adhesive material is melted or plasticized by suitable heating or otherwise as well known. The melted adhesive drains from a bottom port 102 into a tube 104 which is connected through a one-way valve 106 in plunger 2 to the metering chamber 13 to fill chamber 13. The stem 18 is moved down flexing the center portion of the valve plate downwardly creating a vacuum. The lip or edge portion of the valve plate seals against the apical edge 9 at this time as in the previous embodiment. Thus when the chamber 13 is filled and the plunger is fully telescoped with the skirt portion of the can end member the stem 18 is elevated as in the previous embodiment compressing the adhesive which is prevented from returning to the reservoir by the one-way valve. The pressure is sufficient to open the lip edge of the valve plate away from the apical edge 9 thus causing adhesive to spurt out of the chamber 13 against the interior surface of the skirt to initially form the bead 77. Then the base portion 65 with end member 55 is separated from the plunger through relative movement and just prior to withdrawal a blast of air is forced into the end member separating the adhesive in a manner such as best shown in the right half of FIG. 1.

The cycle then is repeated after inserting the end 55 into the pocket in the base portion 65.

The forming of the bead and the programming of the movements provides a deposit of adhesive material such that when the second piece 110 of the can is telescoped into the end piece 55 the raw edge 112 will be buried into the bead 77.

After assembly of the two can parts, the areas at the seam where the adhesive has been applied may be reheated to flow the material and have it stick to hot surfaces.

I claim:

1. A mechanism for applying adhesive to the interior of an axially extending surface of a can component comprising:

a valve body having a lower end with concave cavity bounded by a sharp peripheral edge, a flexible valve plate aligned with said end of said body having a peripheral lip disposed in closing relation to said edge, said plate and body defining a metering chamber, inlet means in said body communicating with said chamber, means for providing a source of flowable adhesive to flow through said inlet means into said chamber, and means for flexing said plate for said adhesive into said metering chamber and for compressing the adhesive within said chamber to exhaust the adhesive from between said edge and lip radially onto said surface.

2. The invention according to claim 1 and said flexing means comprising a stem extending through a bore in said body and having a reduced section defining a reservoir chamber, said stem operable to communicate said reservoir chamber with said metering chamber during a predetermined stroke portion of the stem and to close the communication during another stroke portion and concomitant compression of said adhesive within the metering chamber.

3. The invention according to claim 2 and said adhesive comprising meltable rods and means for feeding said rods into said reservoir chamber, and means in said valve body for heating said rods to flowable plastic state.

4. The invention according to claim 1 and said plate being flexible to expand and to contract said metering chamber.

5. The invention according to claim 1 and means for separating the adhesive from said valve body and that deposited on said surface comprising a blast of air or the like introduced into said can component.

* * * * *